US011142724B2

(12) United States Patent
Kim et al.

(10) Patent No.: US 11,142,724 B2
(45) Date of Patent: Oct. 12, 2021

(54) DETERGENT COMPOSITION FOR PARTIAL CLEANING

(71) Applicant: LG ELECTRONICS INC., Seoul (KR)

(72) Inventors: Minji Kim, Seoul (KR); Jongseok Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 165 days.

(21) Appl. No.: 16/476,735

(22) PCT Filed: Jan. 9, 2018

(86) PCT No.: PCT/KR2018/000382
§ 371 (c)(1),
(2) Date: Jul. 9, 2019

(87) PCT Pub. No.: WO2018/128512
PCT Pub. Date: Jul. 12, 2018

(65) Prior Publication Data

US 2020/0263112 A1 Aug. 20, 2020

(30) Foreign Application Priority Data

Jan. 9, 2017 (KR) ..... 10-2017-0002999

(51) Int. Cl.

| | |
|---|---|
| ***C11D 1/72*** | (2006.01) |
| ***C11D 1/722*** | (2006.01) |
| ***C11D 1/825*** | (2006.01) |
| ***C11D 3/37*** | (2006.01) |
| ***C11D 3/43*** | (2006.01) |
| ***C11D 3/20*** | (2006.01) |
| ***C11D 11/00*** | (2006.01) |

(52) U.S. Cl.
CPC ..... *C11D 3/3715* (2013.01); *C11D 1/8255* (2013.01); *C11D 3/2065* (2013.01); *C11D 3/378* (2013.01); *C11D 3/43* (2013.01); *C11D 11/0017* (2013.01)

(58) Field of Classification Search
CPC ..... C11D 1/72; C11D 1/722; C11D 1/825; C11D 3/2041; C11D 3/3707; C11D 3/3769; C11D 3/378; C11D 3/43
See application file for complete search history.

(56) References Cited

U.S. PATENT DOCUMENTS

| | | | | |
|---|---|---|---|---|
| 2005/0003984 | A1 | 1/2005 | Himmrich et al. | |
| 2014/0274860 | A1 | 9/2014 | Bankers | |
| 2014/0369943 | A1* | 12/2014 | Pilz ..... | C09D 133/02 424/60 |

FOREIGN PATENT DOCUMENTS

| | | |
|---|---|---|
| JP | 2014-152280 | 8/2014 |
| KR | 10-2014-0091565 | 7/2014 |
| KR | 10-1633461 | 6/2016 |
| KR | 10-1647204 | 8/2016 |
| WO | WO 2009/040596 | 4/2009 |

OTHER PUBLICATIONS

International Search Report (with English Translation) and Written Opinion (with English Translation) dated May 21, 2018 issued in Application No. PCT/KR2018/000382.

* cited by examiner

*Primary Examiner* — Brian P Mruk
(74) *Attorney, Agent, or Firm* — KED & Associates LLP

(57) ABSTRACT

A detergent composition for partial cleaning is disclosed. The detergent composition for partial cleaning includes a) a polymer represented by the following Formula 1, b) a nonionic surfactant represented by the following Formula 2, c) a nonionic surfactant represented by the following Formula 3, d) a nonionic stain release agent (SRN), e) a water-soluble solvent, and f) water, wherein the a) polymer represented by Formula 1 is present in an amount of 1 to 10% by weight and has a viscosity of 20,000 cps or more.

10 Claims, No Drawings

DETERGENT COMPOSITION FOR PARTIAL CLEANING

CROSS-REFERENCE TO RELATED PATENT APPLICATIONS

This application is a U.S. National Stage Application under 35 U.S.C. § 371 of PCT Application No. PCT/KR2018/000382, filed Jan. 9, 2018, which claims priority to Korean Patent Application No. 10-2017-0002999, filed Jan. 9, 2017, whose entire disclosures are hereby incorporated by reference.

TECHNICAL FIELD

The present invention relates to a detergent composition for partial cleaning, and more particularly to a detergent composition for partial cleaning to remove partial stains.

BACKGROUND ART

In general, a detergent for partial cleaning is applied to or sprayed onto a stain site of clothes and the stain of the clothes is then removed using a washing machine. Such conventional detergents for partial cleaning may be alkaline or weakly alkaline liquids which are effective in removing the dirt or stains of cotton or shirts.

However, alkaline detergent products for partial cleaning have a problem of inapplicability to wool or silk clothes which are protein materials that may shrink or be deformed due to vulnerability to alkaline.

In addition, conventional detergents for partial cleaning use a surfactant usually in an amount of about 15 to 30%, up to 30% or more and involve the inconvenience of requiring washing with water using a washing machine, etc. The step of washing with water causes a problem of inapplicability of such detergents to clothes requiring dry cleaning.

Korean Patent No. 10-1647204 discloses a portable stain remover using potassium hydroxide. However, this remover uses potassium hydroxide, thus resulting in problems of inapplicability thereof to protein-based clothes as well as shrinkage of clothes when sodium bicarbonate (baking soda) is used.

DISCLOSURE

Technical Problem

Therefore, the present invention has been made in view of the above problems, and it is one object of the present invention to provide a detergent composition for partial cleaning applicable even to protein-based clothes such as wool/silk.

It is another object of the present invention to provide a detergent composition for partial cleaning which maintains a high cleaning rate while lowering a surfactant content.

It is another object of the present invention to provide a detergent composition for partial cleaning which maintains the cleaning rate without changing effects thereof even upon long-term storage.

The objects of the present invention are not limited to those described above and other objects not described herein will be clearly understood by those skilled in the art from the following description.

Technical Solution

In accordance with an aspect of the present invention, the above and other objects can be accomplished by the provision of a detergent composition for partial cleaning including a) a polymer represented by the following Formula 1, b) a nonionic surfactant represented by the following Formula 2, c) a nonionic surfactant represented by the following Formula 3, d) a nonionic stain release agent (SRN), e) a water-soluble solvent, and f) water.

Formula 1

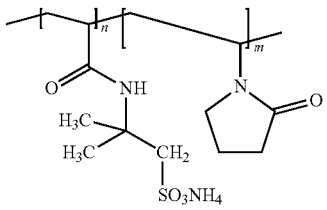

wherein m is an integer of 1 to 50 and n is an integer of 2 to 50.

Formula 2

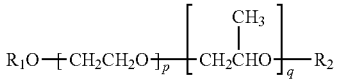

wherein R1 is a linear alkyl, alkenyl or alkynyl group having 9 to 18 carbon atoms, R2 is a linear alkyl, alkenyl or alkynyl group having 1 to 10 carbon atoms, EO is ethylene oxide, p is an average addition mole number of ethylene oxide, of 4 to 15, PO is propylene oxide, and q is an average addition mole number of propylene oxide, of 2 to 6.

$$R_3—O—(CH_2CH_2O)_x—H$$ Formula 3 wherein R3 is a linear alkyl, alkenyl or alkynyl group having 12 to 18 carbon atoms, CH2CH2O (EO) is ethylene oxide, and x is an average addition mole number of ethylene oxide, of 3 to 50.

The a) polymer represented by Formula 1 may present in an amount of 1 to 10% by weight and may have a viscosity of 20,000 cps or more, in order to remove local stains on clothes through the crosslinked structure of Formula 1.

Also, by using the polymer of the structure of Formula 1, the b) nonionic surfactant and the c) nonionic surfactant may be used within a sum of the surfactants, of 10% by weight.

The detergent composition for partial cleaning according to the present invention may include a) 0.1 to 10% by weight of the polymer represented by the following Formula 1, b) 0.5 to 3% by weight of the nonionic surfactant represented by the following Formula 2, c) 1 to 6% by weight of the nonionic surfactant represented by the following Formula 3, d) 1 to 6% by weight of the nonionic stain release agent (SRN), e) 1 to 20% by weight of the water-soluble solvent, and f) the balance of water.

Advantageous Effects

By using a polymer having the structure of Formula 1 and having a viscosity of 20,000 cps or more, the detergent composition for partial cleaning of the present invention has an effect of removing stains on protein-based clothes, even without using an alkali in order to increase viscosity, and has another effect of minimizing stains on clothes due to high viscosity and of being used for removal of stains.

In addition, by using a polymer having the structure of Formula 1 and reducing a surfactant content, the detergent composition for partial cleaning of the present invention has an advantage of providing partial cleaning only by applying the composition to stains and wiping off the same, without a washing process and thus easily and simply removing partial stains.

In addition, by including alkylene glycol, the detergent composition for partial cleaning has effects of preventing freezing of the composition and thus deformation of the polymer having the structure of Formula 1 and thereby enabling long-term storage.

The effects of the present invention are not limited to those described above and other effects not described herein will be clearly understood by those skilled in the art from the description of the claims.

BEST MODE

Hereinafter, preferred embodiments of the present invention and physical properties of respective components will be described in detail and this detailed description is provided only in order for those skilled in the art to easily implement the present invention and should not be construed as limiting the scope and technical concept of the present invention.

The present invention relates to a detergent composition for partial cleaning including a) a polymer represented by Formula 1, b) a nonionic surfactant represented by Formula 2, c) a nonionic surfactant represented by Formula 3, d) a nonionic stain release agent (SRN), e) a water-soluble solvent, and f) water.

The detergent composition for partial cleaning of the present embodiment includes the a) polymer represented by Formula 1 in an amount of 1 to 10% by weight, and maintains a viscosity of 20,000 cps or more. In the detergent composition for partial cleaning of the present embodiment, the sum of the b) nonionic surfactant and the c) nonionic surfactant does not exceed 10% by weight.

The detergent composition for partial cleaning according to the present embodiment includes a) 0.1 to 10% by weight of the polymer represented by the following Formula 1, b) 0.5 to 3% by weight of the nonionic surfactant represented by the following Formula 2, c) 1 to 6% by weight of the nonionic surfactant represented by the following Formula 3, d) 1 to 6% by weight of the nonionic stain release agent (SRN), e) 1 to 20% by weight of the water-soluble solvent, and f) the balance of water. The detergent composition for partial cleaning according to the present embodiment may further include g) 10 to 20% by weight of alkylene glycol.

The detergent composition for partial cleaning of the present invention can easily remove stains on clothes such as wool/silk which cannot be washed with water, and allows partial washing with excellent stain removal effect even without further washing with water.

a) Polymer Having Structure of Formula 1

The polymer used in the detergent composition for partial cleaning according to the present embodiment is represented by the following Formula 1:

Formula 1

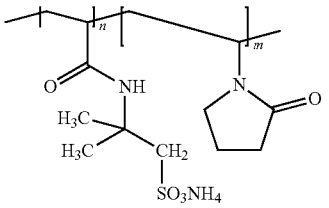

wherein m is an integer of 1 to 50 and n is an integer of 2 to 50.

The polymer used as Formula 1 has excellent releasability to water and is capable of effectively removing a partial stain. However, when the amount of the polymer is more than 10%, there are problems of difficulty in manufacture and poor release properties. Thus, the polymer is preferably used within a range of 10% by weight or less.

The polymer used as Formula 1 according to the present invention serves as a thickener to increase the viscosity of the composition. Hereinafter, the difference between the polymer and a thickener generally used for laundry detergents will be described.

A general thickener has an increased viscosity due to hydrogen bonding with water and the increase in viscosity is possible through neutralization based on the presence of a carboxylic acid group. Since the general thickener is acidic by itself, an alkali is added thereto in order to increase viscosity. This may cause damage to fabric made of protein such as wool, silk or cashmere which is vulnerable (weak) to alkali, and thus is inapplicable.

In addition, the general thickener has no ability to remove oil-soluble and water-soluble stains due to the layered structure, and white residues remain in the fabrics after drying.

On the other hand, the polymer according to the present invention is a neutral substance and thus is increased in viscosity immediately after it is dissolved in water, and the production time is thus shortened. The polymer of Formula 1 of the present invention has a weak acidity of pH 4.5 to 5.5 even when thickened and thus has an effect of being useful for protein-based fabrics.

In addition, the polymer according to Formula 1 of the present invention is cross-linked to a copolymer and thus has excellent ability to remove oil-soluble and water-soluble stains. Therefore, the ability to replace the surfactant is improved. Further, the white thickener phase does not remain in fabrics even after drying.

The polymer of Formula 1 according to the present invention has a viscosity of 20,000 cps or more, thereby minimizing the spreading of strains on the fabric into the outside of the target, or contaminations (stains) on the backside of the fabric. More preferably, the viscosity of the polymer of Formula 1 is maintained at 30,000 cps or more, because the back side of the fabric is hardly contaminated.

The performances of polymeric sulfonic acid that can be used as the polymer of Formula 1, and of carbomer or carboxyl methyl cellulose (CMC) that is used as a general thickener, are shown in Table 1 below.

The data shown in Table 1 were obtained by comparing with a 1% thickener solution, which was prepared and adjusted to a viscosity of about 30,000 cps. The thickener according to Formula 1 was also compared with a composition having a viscosity of 20,000 cps.

First, each thickener was added to purified water, followed by stirring until a transparent liquid was obtained. However, Example 2 was prepared by increasing the viscosity using triethanol amine. The viscosity of the product was the more important factor than pH in consideration of usage, so pH was not controlled separately.

TABLE 1

| | Polymeric sulfonic acid (20000 cps) | Polymeric sulfonic acid (30000 cps) | Carbamer | CMC (Carboxyl methryl cellulose) |
|---|---|---|---|---|
| Water-release ability | ◎ | ◎ | X | ○ |
| Emulsification ability (removal of stains) | ○ | ◎ | ○ | ○ |
| No clothes stains | ◎ | ◎ | X | X |
| No clothes shrinkage | ◎ | ◎ | X | X |
| Applicability to wool/silk | ◎ | ◎ | X | X |
| Solvent mixing stability | ○ | ◎ | ○ | X |
| Minimal contamination of back side of clothes | ○ | ◎ | ○ | X |

Table 2 below shows the items (criteria) for comparison of polymeric sulfonic acid, carbomer and CMC in Table 1 above. Referring to the following Table 2, when the polymeric sulfonic acid is used as a spot cleaner thickener, release from water is faster and stain removal ability is better, as compared to a general thickener. In addition, the polymeric sulfonic acid causes neither stains nor clothes shrinkage and thus has an effect of being applicable to wool/silk. In addition, the polymeric sulfonic acid is stable even when used in combination with a solvent and can minimize the phenomenon in which the back side of clothes is contaminated.

When a polymer sulfonic acid having a viscosity of 20,000 cps is used, the performance is partially deteriorated in terms of the emulsifying ability, solvent mixing stability and the effect of minimizing the contamination or staining on the back side of the clothes, compared with when a polymer sulfonic acid having a viscosity of 30,000 cps is used, but such a polymer has similar effects to the polymer sulfonic acid having a viscosity of 30,000 cps and has superior effects to the general thickener.

TABLE 2

| Solvent mixing stability | ◎ (Excellent) | ○ (Good) | X (Bad) |
|---|---|---|---|
| Water-release ability | Within 30 seconds | Within 1 minute | Within 2 minutes |
| Emulsification ability (removal of stains) | Removal rate of 60% or more | Removal rate of 50% or more | Removal rate of 30% or more |
| No clothes stains | No stains after drying | Presence of only trace | Formation of band in applied region |
| No clothes shrinkage | Less than 0.5% | Less than 0.5% | Less than 4% |
| Applicability to wool/silk | Applicable | Applicable only at limited concentration | Inapplicable |
| Solvent mixing stability | 50% or more | less than 50% | less than 10% |
| Minimal contamination of back side of clothes | Almost no back wetting | Slight back wetting | Severe back wetting |

b) Nonionic Surfactant Having Structure of Formula 2

The nonionic surfactant used in the detergent composition for partial cleaning according to the present embodiment is represented by the following Formula 2.

Formula 2

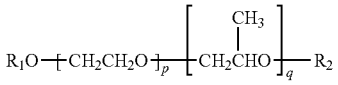

wherein R1 is a linear alkyl, alkenyl or alkynyl group having 9 to 18 carbon atoms, p is an average addition mole number of ethylene oxide, of 4 to 15, and q is an average addition mole number of propylene oxide, of 2 to 6.

The nonionic surfactant used in Formula 2 does not cause foams at room temperature (25° C. to 30° C.) due to the low cloud point (CP) thereof. Therefore, the step of washing with water required due to the foams is omitted. However, the nonionic surfactant maintains the cleaning ability, and particularly, is excellent in the ability to remove hydrophobic contaminants, i.e., the ability to remove oil, even if no foams are generated.

c) Nonionic Surfactant Having Structure of Formula 3

The nonionic surfactant used in the detergent composition for partial cleaning according to the present embodiment is represented by the following Formula 3.

$$R_3—O—(CH_2CH_2O)_x—H$$ Formula 3 wherein R3 is a linear alkyl, alkenyl or alkynyl group having 12 to 18 carbon atoms, CH2CH2O (EO) is ethylene oxide, and x is an average addition mole number of ethylene oxide, of 3 to 50.

The nonionic surfactant used in Formula 3 above is a material which can emulsify stains well in water among surfactants having a low critical micelle concentration (CMC).

The detergent composition for partial cleaning according to the present invention preferably has a concentration of less than 6% which does not cause stains when remaining on the clothes, because the composition is used without washing with water and thus stains remain on silk clothes when the content thereof is greater than 6%. However, when the composition is used in only a small amount of less than 1%, it may affect the cleaning ability. Thus, it is preferable to use the composition in an amount of 1% or more.

The nonionic surfactant of Formula 3 includes nonionic surfactants represented by the following Formulas 3-1 and 3-2.

Formula 3-1

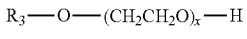

Formula 3-2

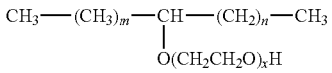

In Formula 3-1, R3 is a linear alkyl, alkenyl or alkynyl group having 12 to 18 carbon atoms, CH2CH2O (EO) is ethylene oxide, and x is an average addition mole number of ethylene oxide, of 3 to 50.

In Formula 3-2, the sum of m and n (m+n) is 12 to 14 and x is 3 to 9.

The sum of the surfactants of Formulas 3-1 and 3-2 may be within the range of the surfactant represented by Formula 3. In addition, a mixture of 0.5 to 5% by weight of the nonionic surfactant represented by Formula 3-1 and 0.5 to 5% by weight of the nonionic surfactant represented by Formula 3-2 may be used.

d) Nonionic Stain Release Agent (SRN)

In the present specification, the nonionic stain release agent is simply referred to as "SRN". The most preferred nonionic SRN for the present invention is based on polyethylene terephthalate-polyoxyethylene terephthalate copolymer (so-called "PET-POET") marketed under the trade name TexCare® SRN by Clariant. Preferred polyester SRN for use in the present invention include TexCare® SRN 100 and TexCare SRN® 300, both of which are available from Clariant. As described above, 1% to 6% by weight of the nonionic stain release agent is preferably present in the detergent composition for partial cleaning of the present invention, based on the total weight of the composition.

TexCare® SRN 100 may represent a 100-mole nonionic stain release agent and TexCare® SRN300 may represent a 300-mole nonionic stain release agent. It is preferable to use 0.5% to 3% of the 100-mole nonionic stain release agent and 0.5% to 3% of the 300-mole nonionic stain release agent (See Table 3) in terms of excellent cleaning effect (see Table 3).

d) Alkylene Glycol

Although alkylene glycol has poor cleaning effect, it can be used for long-term storage stability. Alkylene glycol can be applied in order to prevent damage to clothes and to prevent freezing of high-viscosity products. The alkylene glycol prevents the composition from freezing and thus prevents the crosslinked structure of the polymer represented by Formula 1 from being broken or deformed.

The alkylene glycol used in the detergent composition for partial cleaning according to the present embodiment is represented by the following Formula 4.

$$HO—(R_4)_y—OH \qquad \text{Formula 4}$$

wherein R4 is a linear or branched alkyl group having 1 to 6 carbon atoms when y is 1 and is a linear or branched alkylene oxide having 1 to 6 carbon atoms when y is 2 to 50.

When the content of the alkylene glycol is less than 10%, there is almost no effect of preventing the freezing. When the content of the alkylene glycol is 20% or more, the viscosity of the product is lowered. Thus, it is preferable to use the alkylene glycol in an amount of 10 to 20% by weight.

f) Water-Soluble Solvent

A water-soluble solvent is added for quick drying. The use of the water-soluble solvent maintains the viscosity over a long period of time, causes no deterioration in usability and further maintains deodorization effects.

The water-soluble solvent according to the present embodiment is a medicinal agent which can be mixed with water and may include at least one selected from the group consisting of ethanol (EtOH), n-propanol (NPA), isopropanol (IPA), n-butanol (NBA), n-pentanol (NPA), n-hexanol (NHA) and a combination thereof.

EXAMPLES AND COMPARATIVE EXAMPLES

Hereinafter, the detergent composition for partial cleaning according to the present invention will be described with reference to Examples and Comparative Examples.

The thickener shown in Table 3 or Table 4 was tested after adjusting the viscosity of polymeric sulfonic acid used in Table 1, among the thickeners represented by Formula 1, to about 30,000 cps.

Ethylene oxide/propylene oxide copolymer 1101 (EO/PO copolymer 1101) was used as the nonionic surfactant having the structure of Formula 2. Lauryl alcohol (Alcohol E07) was used as the nonionic surfactant having the structure of Formula 3-1, and ethylene oxide-secondary alcohol (secondary alcohol EO-9) was used as the nonionic surfactant having the structure of Formula 3-2.

Also, 100-moles of nonionic stain release agent (TexCare® SRN 100) and 300 moles of nonionic stain release agent (TexCare® SRN 300) produced by Clariant were used as the nonionic stain release agent (SRN). Ethanol (EtOH) and isopropanol (IPA) were used alone or in combination as the water-soluble solvent. Propylene glycol was used as the alkylene glycol having the structure of Formula 4 for preventing freezing. The composition described above was adjusted to each ratio and then the whole composition ratio was adjusted to 100% using water.

After clothes were contaminated with the composition prepared by adjusting the ratios of the ingredients, whether or not stains remained on the clothes was evaluated.

TABLE 3

| | Example1 | Example2 | Example3 | Example4 | Example5 | Example6 | Example7 |
|---|---|---|---|---|---|---|---|
| Thickener | 1 | 0.5 | 2 | 1 | 1 | 1 | 1 |
| Lauryl Alcohol EO7 | 1 | 1 | 1 | 0.5 | 2 | 1 | 1 |
| EO/PO copolymer 1102 | 1 | 1 | 1 | 1 | 1 | 0.5 | 2 |
| TexCare ® SRN 100 | 1 | 1 | 1 | 1 | 1 | 1 | 1 |
| TexCare ® SRN 300 | 1 | 1 | 1 | 1 | 1 | 1 | 1 |
| IPA | 10 | 10 | 10 | 10 | 5 | 10 | 5 |
| Ethanol | 10 | 10 | 5 | 10 | 5 | 10 | 5 |
| Secondary alcohol EO- 9 | 1 | 1 | 1 | 1 | 1 | 1 | 1 |
| Propylene glycol | 10 | 10 | 10 | 10 | 10 | 10 | 10 |
| Distilled water | Adjusted to total 100% | | | | | | |
| Cleaning performance | ◎ | ○ | ◎ | ○ | ◎ | ○ | ◎ |

| | Example8 | Example9 | Example10 | Example11 | Exemple12 | Example13 |
|---|---|---|---|---|---|---|
| Thickener | 1 | 1 | 1 | 1 | 1 | 1 |
| Lauryl Alcohol EO7 | 1 | 1 | 1 | 1 | 1 | 1 |
| EO/PO copolymer 1102 | 1 | 1 | 1 | 1 | 1 | 1 |
| TexCare ® SRN 100 | 0.5 | 2 | 1 | 1 | 1 | 1 |
| TexCare ® SRN 300 | 1 | 1 | 0.5 | 2 | 1 | 1 |
| IPA | 10 | 5 | 10 | 5 | 10 | 5 |
| Ethanol | 10 | 5 | 10 | 5 | 10 | 5 |
| Secondary alcohol EO- 9 | 1 | 1 | 1 | 1 | 0.5 | 2 |

TABLE 3-continued

| | | | | | | |
|---|---|---|---|---|---|---|
| Propylene glycol | 10 | 10 | 10 | 10 | 10 | 10 |
| Distilled water | | | Adjusted to total 100% | | | |
| Cleaning performance | ○ | ◎ | ○ | ◎ | ○ | ◎ |

TABLE 4

| | Example1 | Comparative Example1 | Comparative Example2 | Comparative Example3 | Comparative Example4 | Comparative Example5 |
|---|---|---|---|---|---|---|
| Thickener | 1 | 1 | 3 | 1 | 1 | 1 |
| Lauryl Alcohol EO7 | 1 | 0.1 | 0.3 | 1 | 1 | 2 |
| EO/PO copolymer 1102 | 1 | 1 | 1 | 0.3 | 0.3 | 1 |
| TexCare ® SRN 100 | 1 | 1 | 1 | 1 | 1 | 0.1 |
| TexCare ® SRN 300 | 1 | 1 | 1 | 1 | 1 | 3 |
| IPA | 10 | 10 | 10 | 10 | 10 | 10 |
| Secondary alcohol EO-9 | 1 | 3 | 1 | 1 | 2 | 3 |
| Propylene glycol | 10 | 10 | 10 | 10 | 10 | 10 |
| Distilled water | | | Adjusted to total 100% | | | |
| Cleaning performance | ◎ | X | Δ | X | Δ | X |

| | Comparative Example6 | Comparative Example7 | Comparative Example8 | Comparative Example9 | Comparative Example10 |
|---|---|---|---|---|---|
| Thickener | 1 | 1 | 1 | 2 | 1 |
| Lauryl Alcohol EO7 | 1 | 3 | 3 | 2 | 1 |
| EO/PO copolymer 1102 | 1 | 1 | 1 | 1 | 1 |
| TexCare ® SRN 100 | 0.3 | 1 | 1 | 2 | 3 |
| TexCare ® SRN 300 | 1 | 0.1 | 0.3 | 1 | 2 |
| IPA | 10 | 10 | 10 | 5 | 10 |
| Secondary alcohol EO-9 | 1 | 1 | 1 | 0.3 | 0.3 |
| Propylene glycol | 10 | 10 | 10 | 10 | 10 |
| Distilled water | | | Adjusted to total 100% | | |
| Cleaning performance | Δ | X | Δ | X | Δ |

Table 3 and Table 4 show cleaning performance according to the compositions of Examples and Comparative examples. As can be seen from Table 5 below, the cleaning performance was determined using a colorimeter compared with washing by a washing machine.

TABLE 5

| Items (Criteria) | Excellent | Good | Fair (moderate) | Poor |
|---|---|---|---|---|
| Cleaning rate (%, compared to washing by washing machine) | 95% or more | 90~94% | 85~89% | 80~84% |
| Symbol | ◎ | ○ | Δ | X |

The examples of Table 3 show that the cleaning rate is 90% or more in examples that satisfy the ranges of a) 0.1 to 10% by weight of the polymer represented by Formula 1, b) 0.5 to 3% by weight of the nonionic surfactant represented by Formula 2, c) 1 to 6% by weight of the nonionic surfactant represented by Formula 3, d) 1 to 6% by weight of the non-ionic pollutants (SRN), e) 1 to 20% by weight of the water-soluble solvent, and f) 10 to 20% by weight of the alkylene glycol.

Specifically, the cleaning rate is found to be 90% or more in examples that satisfy the ranges of a) 0.1 to 10% by weight of the polymer represented by Formula 1, b) 0.5 to 3% by weight of the nonionic surfactant represented by Formula 2, c1) 0.5 to 5% by weight of the nonionic surfactant represented by Formula 3-1, c2) 0.5 to 5% by weight of the nonionic surfactant represented by Formula 3-2, d1) 0.5 to 3% by weight of the 100-mole nonionic stain release agent, d2) 0.5 to 3% by weight of the 300-mole non-ionic stain release agent, e) 1 to 20% by weight of the water-soluble solvent, and f) 10 to 20% by weight of the alkylene glycol.

Furthermore, the cleaning rate is found to be 95% or more in examples that satisfy the ranges of a) 1 to 10% by weight of the polymer represented by Formula 1, b) 1 to 3% by weight of the nonionic surfactant represented by Formula 2, c1) 1 to 5% by weight of the nonionic surfactant represented by Formula 3-1, c2) 1 to 5% by weight of the nonionic surfactant represented by Formula 3-2, d1) 1 to 3% by weight of the 100-mole nonionic stain release agent, d2) 1 to 3% by weight of the 300-mole non-ionic stain release agent, e) 1 to 20% by weight of the water-soluble solvent, and f) 10 to 20% by weight of the alkylene glycol.

Also, as can be seen from Table 3, the surfactant used for the composition of the present embodiment includes the nonionic surfactant represented by Formula 2, the nonionic surfactant represented by Formula 3-1, and the nonionic surfactant represented by Formula 3-2, and when the total content of these ingredients is 3% or less, the cleaning rate is 95% or more. Also, the cleaning rate is found to be 95% or more, even though 2% by weight of the non-ionic stain release agent is added, or the surfactant and the non-ionic stain release agent are added in amounts of 5% by weight or less.

The detergent composition for partial cleaning according to the present embodiment has an advantage of removing partial stains after using the composition, even without a separate clothing washing process, by significantly reducing the content of the surfactant.

On the other hand, as can be seen from Table 4, the cleaning rate does not satisfy 90% or more, when the nonionic surfactant represented by Formula 2 is used in an amount of less than 0.5% by weight, the nonionic surfactant represented by Formula 3-1 is used in an amount of less than 0.5% by weight, or the nonionic surfactant represented by Formula 3-2 is used in an amount of less than 0.5% by weight.

Also, as can be seen from Table 4, the cleaning rate does not satisfy 90% or more, when the 100-mole non-ionic stain release agent (TexCare® SRN 100) or the 300-mole non-ionic stain release agent (TexCare® SRN 300) is used in an amount of less than 0.5% by weight.

The invention claimed is:

1. A detergent composition for partial cleaning comprising:

a) a polymer represented by the following Formula 1;

b) a nonionic surfactant represented by the following Formula 2;

c) a nonionic surfactant represented by the following Formula 3;

d) a nonionic stain release agent (SRN);

e) a water-soluble solvent; and f) water, wherein the a) polymer represented by Formula 1 is present in an amount of 0.1 to 10% by weight and has a viscosity of 20,000 cps or more, Formula 1

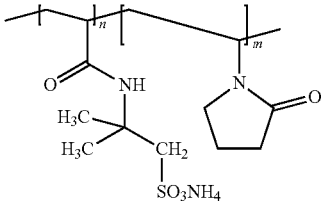

wherein m is an integer of 1 to 50 and n is an integer of 2 to 50,

Formula 2

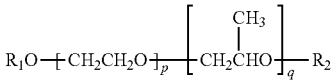

wherein $R_1$ is a linear alkyl, alkenyl or alkynyl group having 9 to 18 carbon atoms, $R_2$ is a linear alkyl, alkenyl or alkynyl group having 1 to 10 carbon atoms, $CH_2CH_2O$ is ethylene oxide, p is an average addition mole number of ethylene oxide, of 4 to 15, $CH_3CHCH_2O$ is propylene oxide, and q is an average addition mole number of propylene oxide, of 2 to 6, $R_3—O—(CH_2CH_2O)_x—H$ Formula 3 wherein $R_3$ is a linear alkyl, alkenyl or alkynyl group having 12 to 18 carbon atoms, $CH_2CH_2O$ is ethylene oxide, and x is an average addition mole number of ethylene oxide, of 3 to 50.

2. The detergent composition for partial cleaning according to claim 1, wherein a sum of the b) nonionic surfactant and the c) nonionic surfactant does not exceed 10% by weight.

3. The detergent composition for partial cleaning according to claim 1, comprising:

a) 0.1 to 10% by weight of the polymer represented by Formula 1;

b) 0.5 to 3% by weight of the nonionic surfactant represented by Formula 2;

c) 1 to 6% by weight of the nonionic surfactant represented by Formula 3;

d) 1 to 6% by weight of the nonionic stain release agent (SRN);

e) 1 to 20% by weight of the water-soluble solvent; and f) the balance of water.

4. The detergent composition for partial cleaning according to claim 3, further comprising:

10 to 20% by weight of alkylene glycol.

5. The detergent composition for partial cleaning according to claim 4, wherein the alkylene glycol is represented by the following Formula 4:

$HO—(R_4)_y—OH$ Formula 4 wherein $R_4$ is a linear or branched alkyl group having 1 to 6 carbon atoms when y is 1 and is a linear or branched alkylene oxide having 1 to 6 carbon atoms when y is 2 to 50.

6. The detergent composition for partial cleaning according to claim 3, wherein the c) nonionic surfactant comprises:

c1) 0.5 to 5% by weight of a nonionic surfactant represented by the following Formula 3-1; and c2) 0.5 to 5% by weight of a nonionic surfactant represented by the following Formula 3-2, $R_3—O—(CH_2CH_2O)_x—H$ Formula 3-1 wherein $R_3$ is a linear alkyl, alkenyl or alkynyl group having 12 to 18 carbon atoms, $CH_2CH_2O$ is ethylene oxide, and x is an average addition mole number of ethylene oxide, of 3 to 50, and Formula 3-2

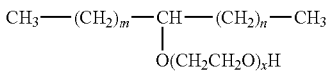

wherein a sum of m and n (m+n) is 12 to 14, and x is 3 to 9.

7. The detergent composition for partial cleaning according to claim 1, wherein the nonionic stain release agent comprises polyethylene terephthalate and polyoxyethylene terephthalate.

8. The detergent composition for partial cleaning according to claim 3, wherein the e) water-soluble solvent comprises at least one selected from the group consisting of ethanol (EtOH), n-propanol (NPA), isopropanol (IPA), n-butanol (NBA), n-pentanol (NPA), n-hexanol (NHA) and a combination thereof.

9. The detergent composition for partial cleaning according to claim 3, wherein the d) nonionic stain release agent comprises:

d1) 0.5 to 3% by weight of a 100-mole nonionic stain release agent; and d2) 0.5 to 3% by weight of a 300-mole non-ionic stain release agent.

10. The detergent composition for partial cleaning according to claim 1, wherein the detergent composition has a viscosity of 30,000 cps or more.

* * * * *